US008347557B2

(12) United States Patent
Minor, Sr. et al.

(10) Patent No.: US 8,347,557 B2
(45) Date of Patent: Jan. 8, 2013

(54) GUTTER HANGER

(76) Inventors: Kenneth W. Minor, Sr., Channahon, IL (US); Keith W. Minor, Sr., Channahon, IL (US)

( * ) Notice: Subject to any disclaimer, the term of this patent is extended or adjusted under 35 U.S.C. 154(b) by 453 days.

(21) Appl. No.: 12/590,300

(22) Filed: Nov. 4, 2009

(65) Prior Publication Data

US 2011/0099916 A1 May 5, 2011

(51) Int. Cl.
*E04D 13/00* (2006.01)

(52) U.S. Cl. ..... 52/11; 52/12; 52/60

(58) Field of Classification Search ..... 52/11, 12, 52/60; 248/48.2
See application file for complete search history.

(56) References Cited

U.S. PATENT DOCUMENTS

| | | | | |
|---|---|---|---|---|
| 2,209,741 | A | 7/1940 | Sullivan et al. | |
| 2,988,226 | A | 6/1961 | Campbell | |
| 3,053,393 | A | 9/1962 | McLean | |
| 3,436,878 | A | 4/1969 | Singer | |
| 4,195,452 | A | 4/1980 | Smith et al. | |
| 4,241,548 | A | 12/1980 | Rowe | |
| 5,007,224 | A | 4/1991 | Segneri | |
| 5,271,192 | A | 12/1993 | Nothum, Sr. et al. | |
| 5,388,377 | A | 2/1995 | Faulkner | |
| 5,566,513 | A | 10/1996 | Herren | |
| 6,254,039 | B1 * | 7/2001 | Zimmerman | 248/48.2 |
| 6,427,388 | B1 | 8/2002 | Brochu | |
| 6,786,008 | B2 | 9/2004 | Brochu | |
| 6,854,692 | B1 | 2/2005 | Winkel | |
| 6,944,992 | B2 | 9/2005 | Brochu | |
| D523,538 | S | 6/2006 | Brochu | |
| 7,143,549 | B2 | 12/2006 | Brochu | |
| 7,614,185 | B2 * | 11/2009 | Brochu | 52/11 |
| 2008/0120920 | A1 | 5/2008 | Knudson et al. | |

* cited by examiner

*Primary Examiner* — William Gilbert
*Assistant Examiner* — Patrick Maestri
(74) *Attorney, Agent, or Firm* — Wood, Phillips, Katz, Clark & Mortimer

(57) ABSTRACT

A gutter hanger having a mounting portion to be secured to a building frame and a support portion to engage a gutter in an operative position on the building frame. The mounting portion has first and second legs joined together to define an upwardly opening "U" shape to receive a depending flashing portion with the mounting portion secured to a building frame.

21 Claims, 8 Drawing Sheets

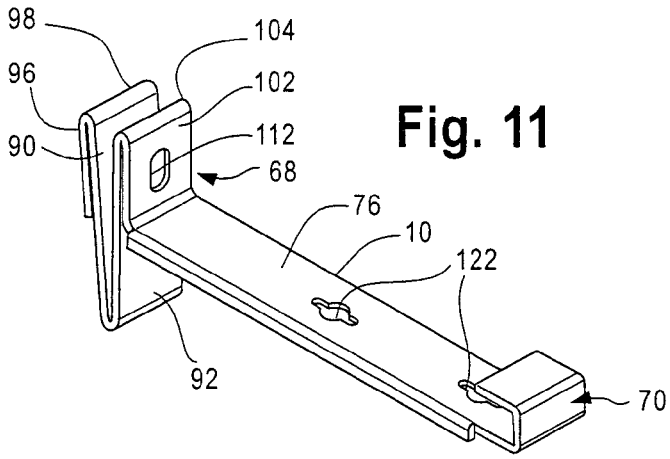
Fig. 11
Fig. 13
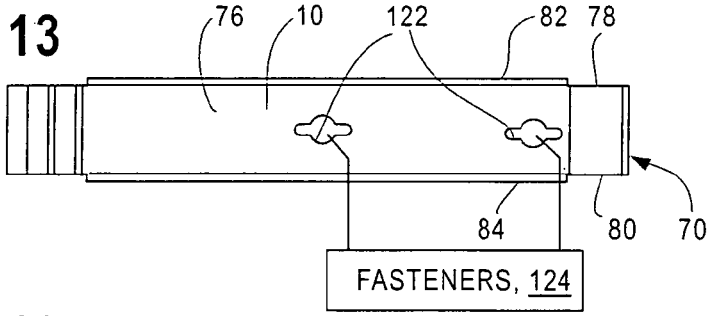
Fig. 12
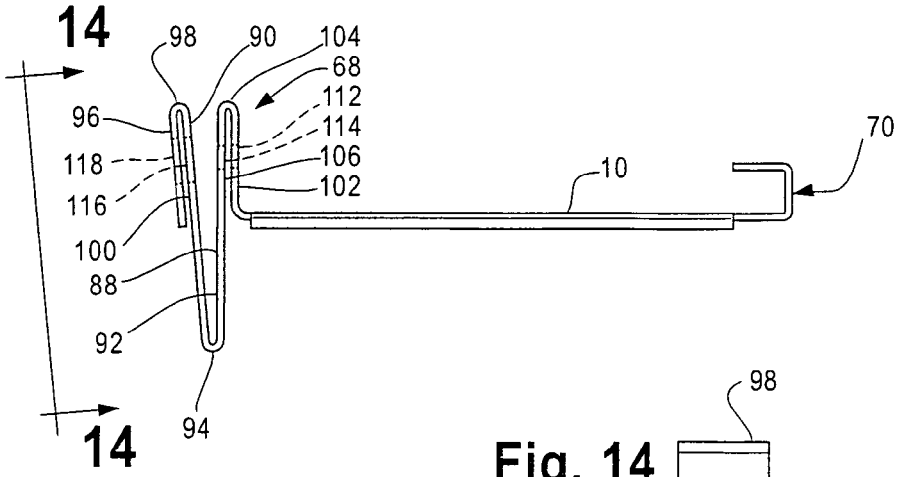
Fig. 14
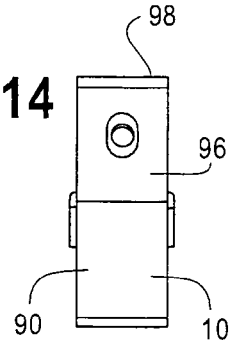

GUTTER HANGER

BACKGROUND OF THE INVENTION

1. Field of the Invention

This invention relates to gutters and, more particularly, to fascia-mounted hangers through which gutters are operatively supported upon building frames.

2. Background Art

In a common roof construction, shingles or roll roofing are installed to define a water impervious covering that overlies a surface that terminates at a fascia. To avoid downward movement of water from the lower extremities of the shingles or sheet roofing to against the fascia, a flashing component is provided and wrapped over an edge at a juncture between the roof surface and fascia.

Typically, the flashing component will be in the form of a metal sheet that is bent to define angled portions. One of the angled portions resides between the roof covering and roof surface, with the other angled portion depending to overlie an exposed fascia surface, thereby shielding the same.

Lengths of gutter are commonly installed using hangers that have spaced mounting and front support portions. The mounting portion is secured to the fascia using fasteners that extend preferably into rafter components. With the hangers fixed in place, the front support portions engage the front region of the gutter to provide vertical support at that location.

A number of different techniques have been devised to integrate the hanger mounting portion with the flashing at the fascia. Certain of these techniques are described hereinbelow with respective FIGS. 7-9. In each instance, the function of the flashing is compromised to the point that moisture is allowed to migrate to against the fascia which, over time, can cause a progressive deterioration that may necessitate regular maintenance and, in a worse case, replacement of some or all of the fascia components.

In spite of the fact that the gutter industry is mature, designers in this field have yet to come up with a commercially feasible system that allows conventional-type hanger components to be integrated with flashing at a fascia region without creation of detrimental openings through which moisture can migrate to against fascia surfaces. The industry continues to seek out designs that address at least the above problems.

SUMMARY OF THE INVENTION

In one form, the invention is directed to a combination including: a building frame defining a roof surface and a fascia, the roof surface and fascia meeting at an edge; a water impervious covering over the roof surface; and flashing that wraps around the edge and extends between the roof surface and covering, with the flashing having a depending portion that overlies the fascia and terminates at a free edge. The combination further includes a gutter hanger with a mounting portion, that is secured to the building frame, and a support portion. A gutter is secured to the building frame and engaged by the support portion to be maintained in an operative position upon the building frame. The mounting portion of the gutter hanger defines an upwardly opening "U" shape in which the depending portion of the flashing nests.

In one form, the upwardly opening "U" shape is defined by first and second legs and the gutter is secured to the building frame through a fastener that extends through the first and second legs and the depending portion of the flashing and into the fascia.

In one form, the upwardly opening "U" shape is defined by first and second legs and the mounting portion further has an inner leg that is joined to the first leg through a first bight portion. The first and inner legs each resides between the depending portion of the flashing and the fascia.

In one form, the first and inner legs and first bight portion cooperatively define an inverted "U" shape.

In one form, the mounting portion further has an outer leg that is joined to the second leg through a second bight portion. The depending portion of the flashing resides between the fascia and each of the second and outer legs.

In one form, the second and outer legs and second bight portion cooperatively define an inverted "U" shape.

In one form, the first, second, inner and outer legs and first and second bight portions cooperatively define an "M" shape.

In one form, a fastener extends through each of the inner and outer legs and into the fascia.

In one form, the gutter has a rear mounting wall, a bottom wall, and a front wall and the rear mounting wall of the gutter resides between the inner leg and the fascia.

In one form, the gutter has a rear mounting wall, a bottom wall, and a front wall and the rear mounting wall of the gutter resides between the first and inner legs.

In one form, the support portion of the gutter hanger engages the front wall of the gutter.

In one form, the rear mounting wall, bottom wall, and front wall of the gutter cooperatively bound an upwardly opening trough, and the gutter hanger spans between the front and rear mounting walls on the gutter above the bottom wall.

In one form, the trough has a top opening with an area and the gutter hanger defines a porous wall that extends over a majority of the top opening area. The porous wall is configured to allow passage of moisture and block movement of foreign matter, such as leaves, through the top opening and into the trough.

In one form, the first, second, inner and outer legs each has a vertical extent and the vertical extent of each of the first and second legs is greater than the vertical extent of each of the inner and outer legs.

In one form, the gutter hanger is formed as one piece.

The invention is further directed to a gutter hanger including a mounting portion to be secured to a building frame and a support portion to engage a gutter in an operative position on a building frame. The mounting portion has first and second legs joined together to define an upwardly opening "U" shape to receive a depending flashing portion with the mounting portion secured to a building frame.

In one form, the mounting portion has an inner leg that is joined to the first leg through a first bight portion, and the first and inner legs and first bight portion cooperatively define an inverted "U" shape.

In one form, the mounting portion has an outer leg that is joined to the second leg through a second bight portion, and the second and outer legs and second bight portion cooperatively define an inverted "U" shape.

In one form, the first, second, inner and outer legs and first and second bight portions cooperatively define an "M" shape.

In one form, the gutter hanger defines a porous wall to extend over a substantial area of a top opening of a trough defined by a gutter that is operatively mounted to a building frame through the gutter hanger. The porous wall is configured to allow passage of moisture and block movement of foreign matter such as leaves through the top opening and into the trough.

In one form, the gutter hanger is provided in combination with a gutter defining an upwardly opening trough and having a mounting wall and a front wall. The gutter hanger spans the trough and engages the front wall.

In one form, the first, second, inner and outer walls have aligned openings to allow a fastener to be directed therethrough.

In one form, the trough has a top opening with an area and the gutter hanger defines a porous wall that extends over a majority of the top opening area. The porous wall is configured to: a) allow passage of moisture; and b) block movement of foreign matter, such as leaves, through the top opening and into the trough.

In one form, the gutter hanger has a support portion that engages the front wall of the gutter and an elongate section between the mounting and support portions. The elongate section is in the form of a flat strip with a reinforcing rib.

BRIEF DESCRIPTION OF THE DRAWINGS

FIG. 11 is a perspective view of the gutter hanger in FIG. 10;

FIG. 12 is a side elevation view of the gutter hanger in FIGS. 10 and 11;

FIG. 13 is a plan view of the gutter hanger in FIGS. 10-12;

FIG. 14 is an end elevation view of the gutter hanger in FIGS. 10-13;

DETAILED DESCRIPTION OF THE PREFERRED EMBODIMENT

Figure 1:
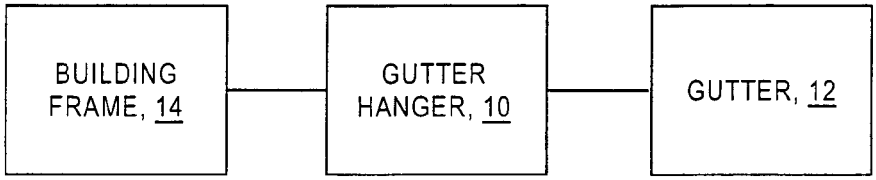
FIG. 1 is a schematic representation of a system, including a gutter hanger according to the present invention, that is utilized to maintain a gutter in an operative position upon a building frame.
Figure 2:
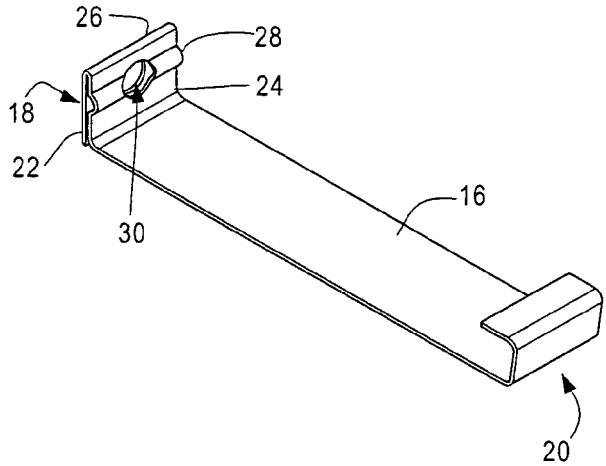
Fig. 2 Prior Art
FIG. 2 is a perspective view of a conventional gutter hanger.
Figure 3:
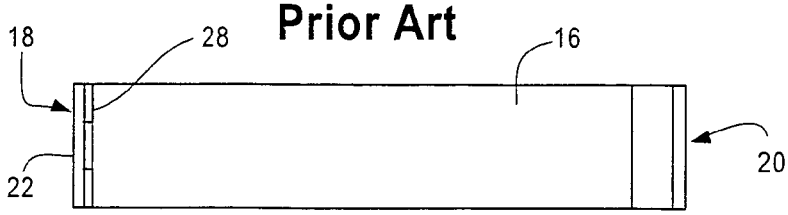
Fig. 3 Prior Art
FIG. 3 is a plan view of the gutter hanger in FIG. 2.
Figure 5:
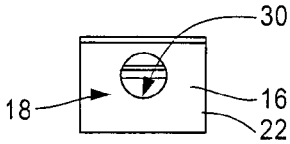
Fig. 5 Prior Art
FIG. 5 is an end elevation view of the gutter hanger in FIGS. 2-4.
Figure 4:
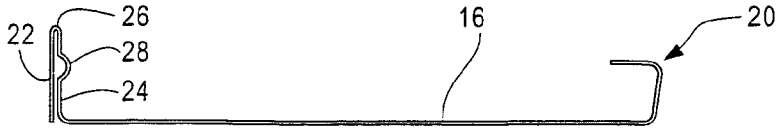
Fig. 4 Prior Art
FIG. 4 is a side elevation view of the gutter hanger in FIGS. 2 and 3.

The present invention is directed to a gutter hanger, shown schematically in FIG. 1 at 10, that is used to secure a gutter 12 to a building frame 14. The gutter 12 and building frame 14 are shown in schematic form since the specific configuration therefor is not critical to the present invention. The inventive gutter hanger 10 can be used on virtually any type of building construction that requires a gutter to direct rain, and the like, controllably to a deposition location, as through a downspout.

One conventional form of gutter hanger is shown at 16 in FIGS. 2-5. The gutter hanger 16 is made in a continuous strip form and has a mounting portion 18 that is secured to the building frame 14 through an appropriate fastener (not shown), and a support portion 20 that engages the gutter 12 at a front region thereon to maintain the gutter 12 in an operative position on the building frame 14.

In this embodiment, the mounting portion 18 has spaced walls 22, 24, joined at a bight portion 26 to cooperatively define an inverted "U" shape. The wall 24 is formed to define an integral reinforcing rib 28.

An opening 30 is defined through the walls 22, 24 to accommodate a fastener (not shown).

Figure 6:
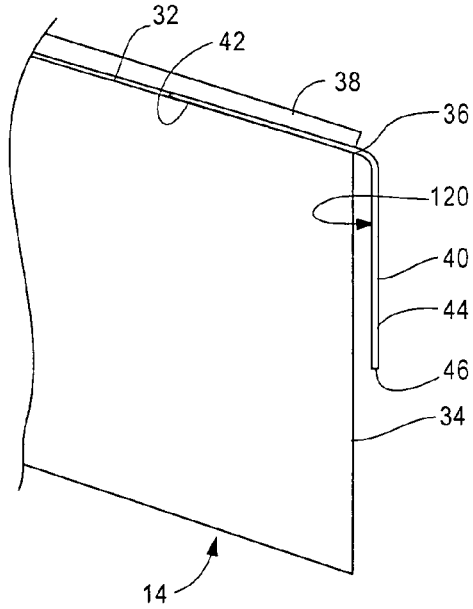
Fig. 6 Prior Art
FIG. 6 is a fragmentary, elevation view of a fascia region on the building frame in FIG. 1 with flashing and a covering for a roof surface.

At a typical mounting location, as shown in FIG. 6, the building frame 14 defines a roof surface 32 and a fascia 34. The roof surface 32 and fascia 34 meet at an edge 36. As used herein, "fascia" is intended to encompass any generally horizontally facing surface to which a gutter is mounted to controllably route water flowing thereto from a roof surface. While the roof surface 32 and fascia 34 are shown to meet at a sharp edge 36, there may be some spacing or offset between these components where they meet. For purposes of simplicity herein, all of these junctures will be considered to be an "edge".

A water impervious covering 38 is placed over the roof surface 32. This covering may be in the form of shingles and/or sheeting, and the like. Underlayment (not shown) may also be utilized as part of the covering system for the roof surface 32.

Flashing 40 wraps around the edge 36. A portion 42 of the flashing 40 extends between the roof surface 32 and covering 38. The flashing 40 has a depending portion 44 that overlies the fascia 34 and terminates at a free edge 46. The depending portion 44 may flushly abut the fascia 34 but is more commonly spaced slightly outwardly therefrom.

Figure 7:
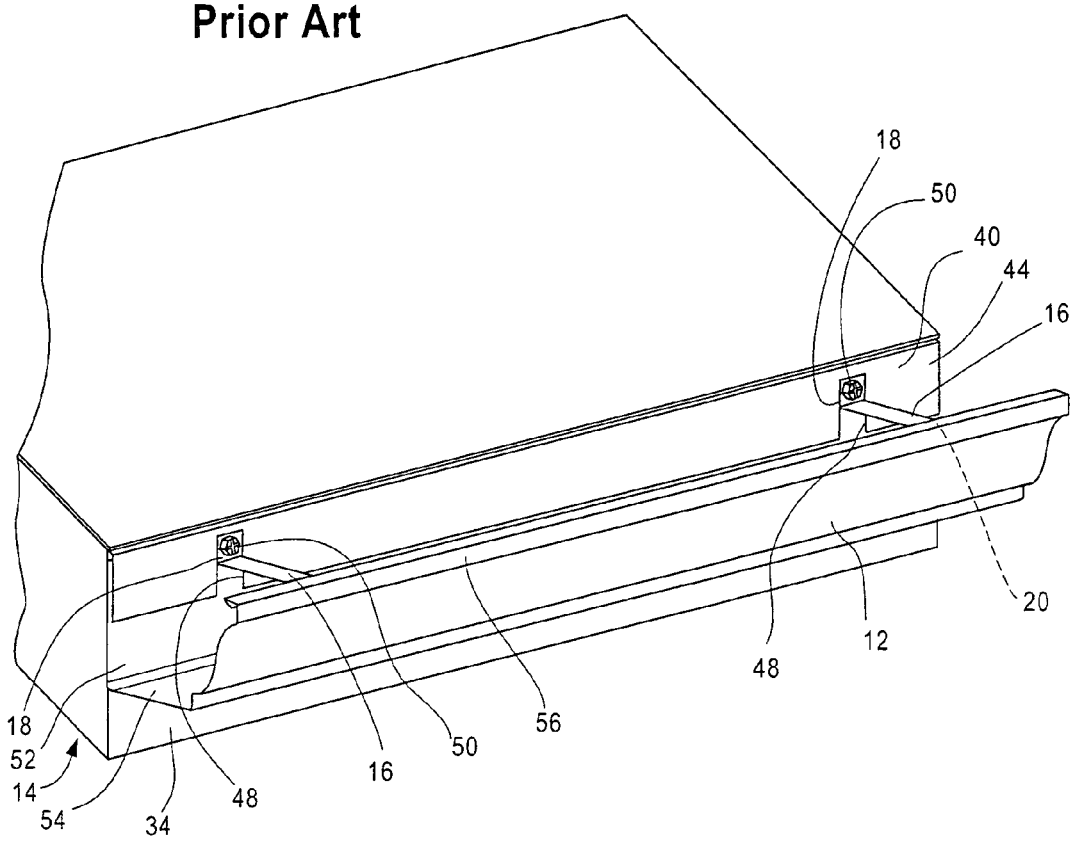
Fig. 7 Prior Art
FIG. 7 is a perspective view of the fascia region, as in FIG. 6, showing one known technique for mounting a gutter using the gutter hanger in FIGS. 2-5.

In FIG. 7, one known technique for installing the gutter 12 on the building frame 14, using the hanger 16, is shown. Generally rectangular cutouts 48 are formed through the depending portion 44 of the flashing 40, at each location where a hanger 16 is to be installed. The cutouts 48 are configured to be nominally matched to the shape of the hanger mounting portions 18 that can be directed therethrough to against the fascia 34 without significant interference. Fasteners 50 are then directed through the openings 30 to secure the gutter hangers 16 to the fascia 34.

The gutter 12 has a rear mounting wall 52, a bottom wall 54, and a front wall 56. With the gutter 12 secured to the building frame 14, in an operative position as shown in FIG. 7, the rear mounting wall 52 is captively maintained by the mounting portion 18 of each gutter hanger 16 against the fascia 34. A front wall 56 of the gutter 12 is engaged by each of the support portions 20 on the gutter hangers 16, which exert an upward holding force thereupon to, in conjunction with the mounting portions 18, maintain the gutter 12 in the operative position upon the building frame 14.

As can be seen in FIG. 7, the cutouts 48 create discrete air gaps therearound through which moisture is permitted to migrate to against the fascia 34.

Figure 8:
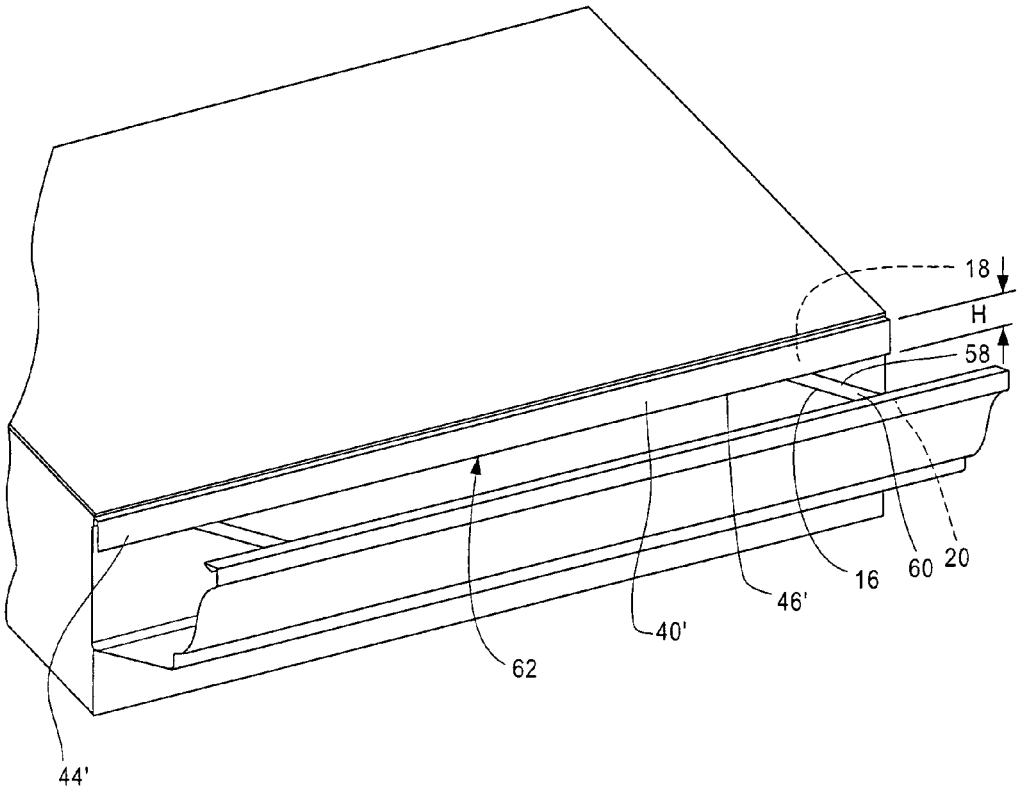
Fig. 8 Prior Art
FIG. 8 is a view as in FIG. 7 showing a modified conventional technique for mounting a gutter using the gutter hanger in FIGS. 2-5.

With an alternative, known technique, as shown in FIG. 8, a depending portion 44' of a flashing 40', corresponding to the depending flashing portion 44 in FIG. 7, is made with a shorter vertical height H so that the free edge 46' abuts to a top edge 58 of a strip length 60 that spans between the mounting portion 18 and support portion 20 on each gutter hanger 16.

The shortened height of the depending portion 44' creates an air gap 62 at the bottom free edge 46' through which moisture may be allowed to migrate to against the fascia 34.

Figure 9:
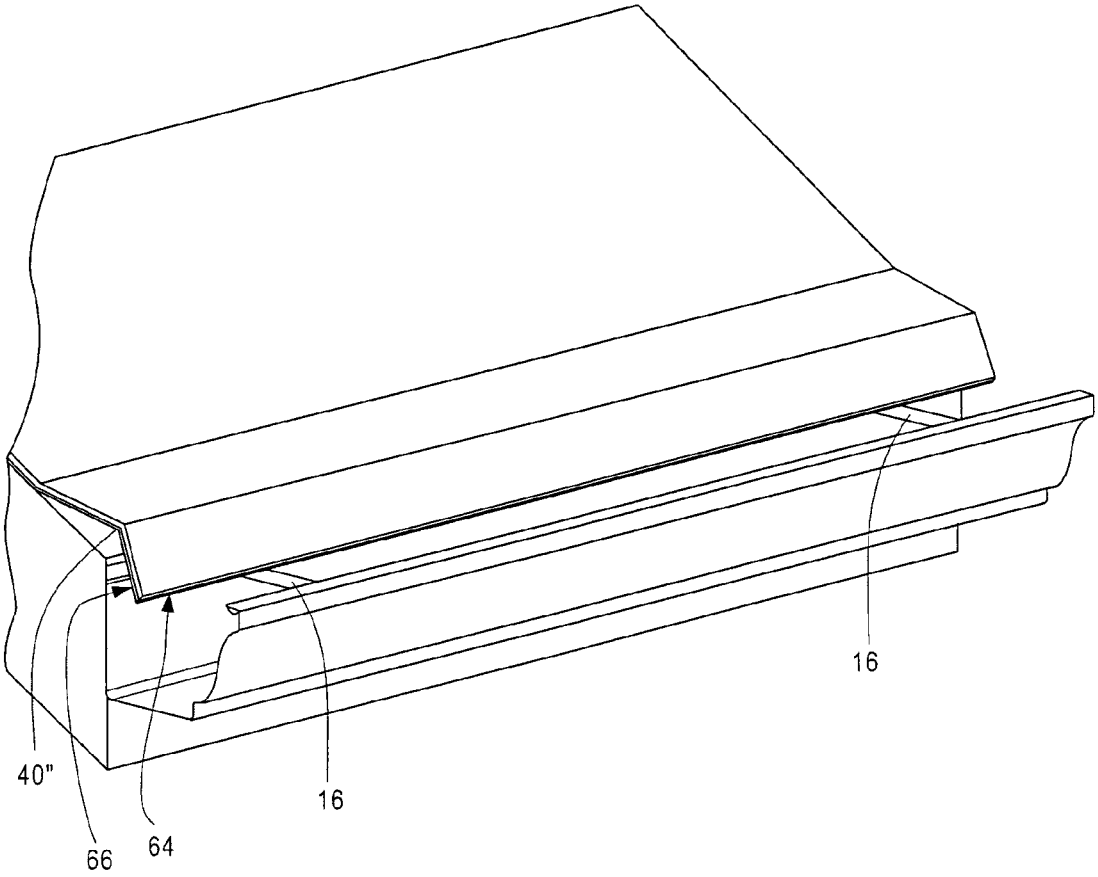
Fig. 9 Prior Art
FIG. 9 is a view as in FIGS. 7 and 8 of a further modified form of technique for mounting a gutter using the gutter hanger in FIGS. 2-5.

In FIG. 9, another conventional technique is disclosed wherein a flashing 40" is bent to an inverted "V" shape to extend up and around the hangers 16.

This construction generates separate air gap locations 64, 66 through which moisture could potentially migrate to against the fascia 34.

As noted above, repeated flow of moisture to against the fascia 34 could lead to its deterioration. This condition may require frequent upkeep and potentially eventually necessitate replacement of part or all of the fascia region.

One preferred form of the inventive gutter hanger 10 is shown in FIGS. 10-14. The gutter hanger 10 consists of a mounting portion 68, that is secured to the building frame 14 at the fascia 34, and a support portion 70. The gutter 12 is shown secured to the building frame 14 and maintained in an operative position thereupon through the mounting portion 68 and the support portion 70, that nests in a formed portion 72 on the front wall 56 of the gutter 12.

In this embodiment, the rear mounting wall 52, bottom wall 54, and front wall 56 of the gutter 12 cooperatively bound an upwardly opening trough 74. The gutter hanger 10 spans between the front and rear mounting walls 56, 52, respectively, above the bottom wall 54 in a "hidden" construction, which is not a requirement for the present invention.

In this embodiment, an elongate, flat section 76 extends between the mounting portion 68 and the support portion 70. As depicted, the elongate section 76 is in the form of a flat strip with spaced edges 78, 80, each reinforced by a rib 82, 84, respectively.

The details of the support portion 70 are not critical to the present invention. It suffices to say that the support portion 70 nests in a receptacle 86 defined by the formed gutter part 72.

The mounting portion 68 on each gutter hanger 10 defines an upwardly opening, U-shaped receptacle 88 in which the depending portion 44 of the flashing 40 nests. The "U" shape is defined by first and second legs 90, 92, respectively, joined at a curved bight portion 94.

The mounting portion further includes an inner leg 96 that is joined to the first leg 90 through a curved bight portion 98. The inner leg 96, first leg 90, and bight portion 98 cooperatively define a receptacle 100 with a "U" shape that opens downwardly. The inner leg 96 and first leg 90 are in substantially parallel and closely adjacent relationship.

The mounting portion 68 further has an outer leg 102 joined to the second leg 92 through a curved bight portion 104. The second leg 92, outer leg 102, and bight portion 104 cooperatively define a receptacle 106 that has a "U" shape that opens downwardly.

The outer leg 102 has a bend 108 at which the outer leg 102 blends into the elongate, flat section 76.

Figure 10:
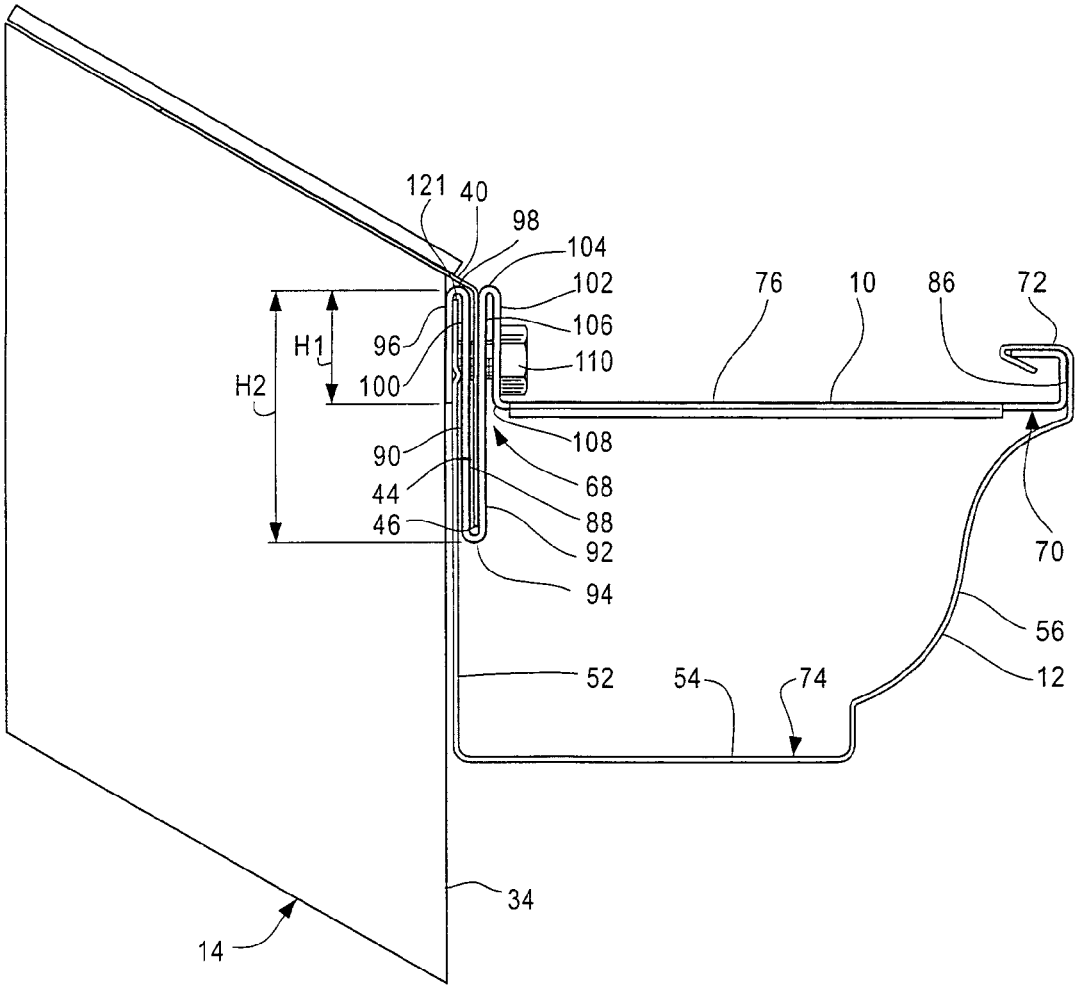
FIG. 10 is a view as in FIG. 6 with a gutter operatively mounted using one specific form of the inventive gutter hanger shown schematically in FIG. 1.
Figure 15:
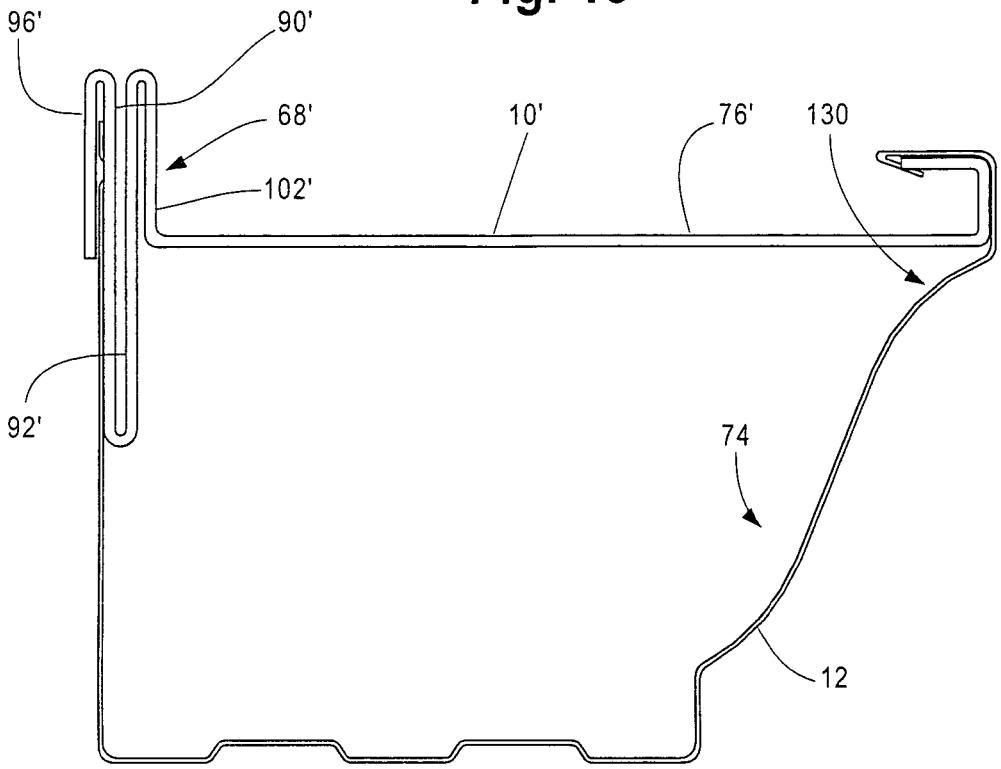
FIG. 15 is a view as in FIG. 10 of a modified form of gutter hanger, according to the present invention, and defining a porous wall to block movement of foreign matter into a trough defined by the gutter.
Figure 16:
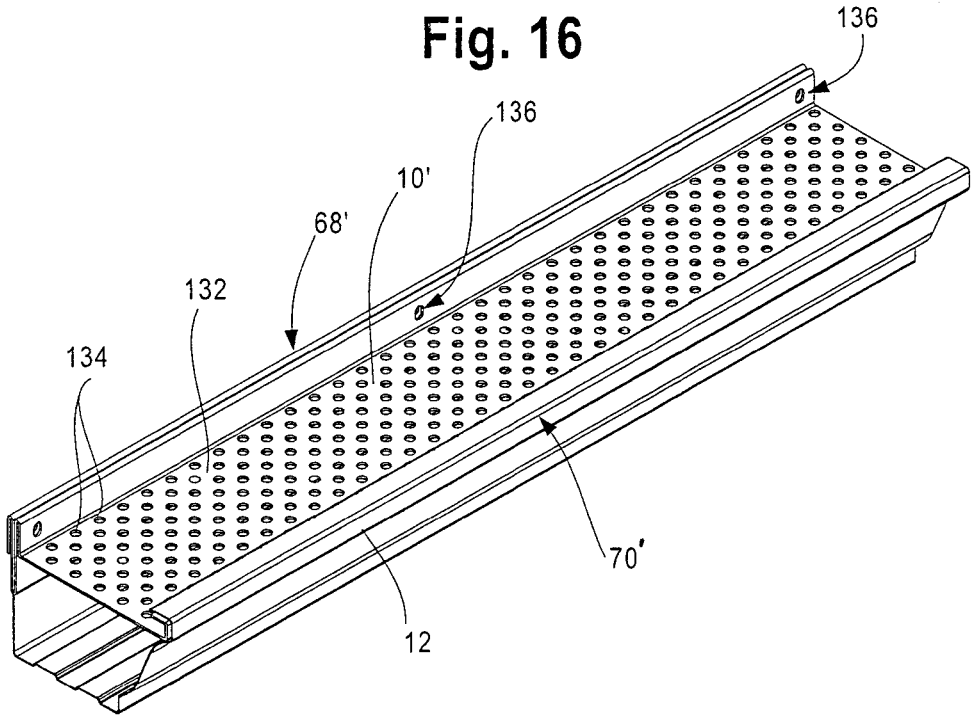
FIG. 16 is a reduced perspective view of a length of gutter with the gutter hanger in FIG. 15 operatively positioned thereupon.
Figure 17:
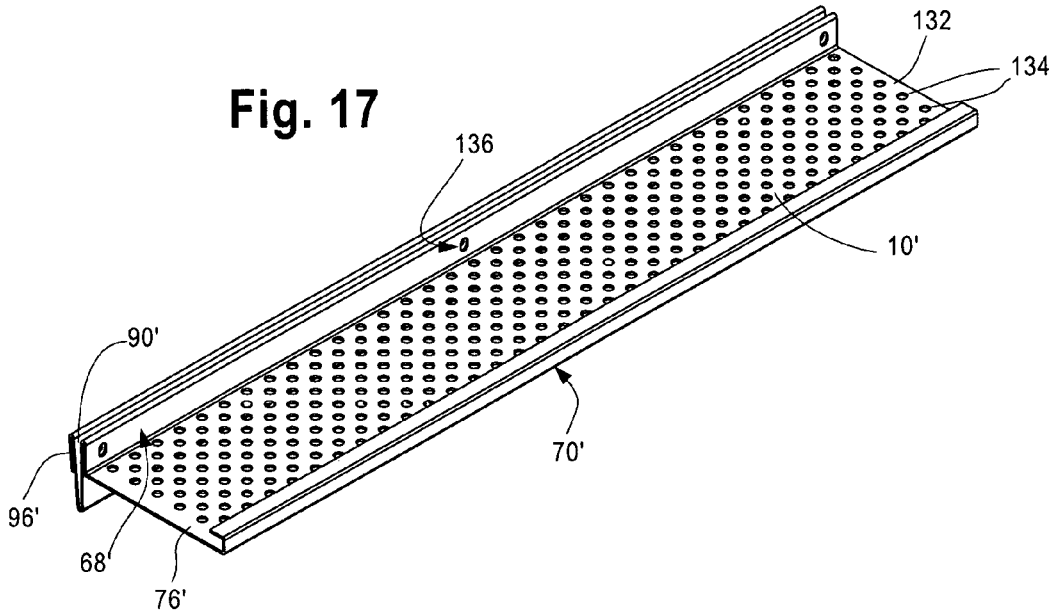
FIG. 17 is a reduced perspective view as in FIG. 16 and showing the gutter hanger separated from the gutter.
Figure 18:
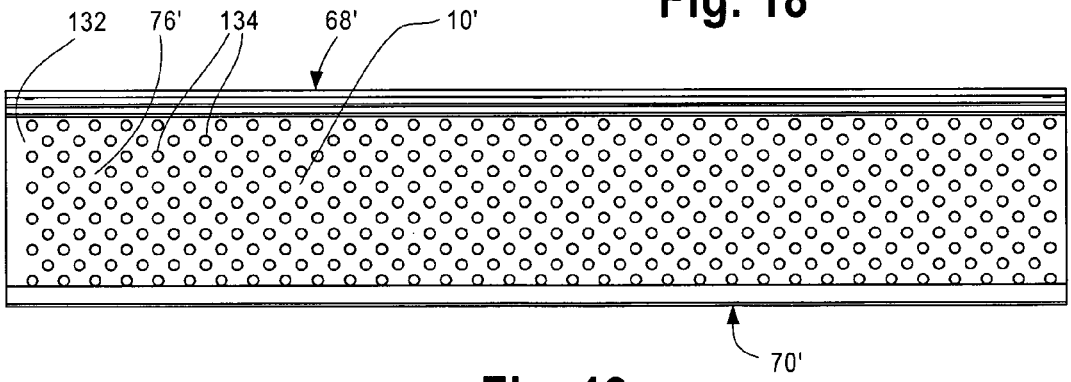
FIG. 18 is a reduced plan view of the gutter hanger in FIGS. 15-17.
Figure 19:
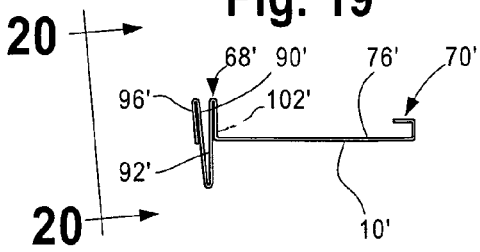
FIG. 19 is a reduced, side, elevation view of the gutter hanger in FIGS. 15-18.
Figure 20:
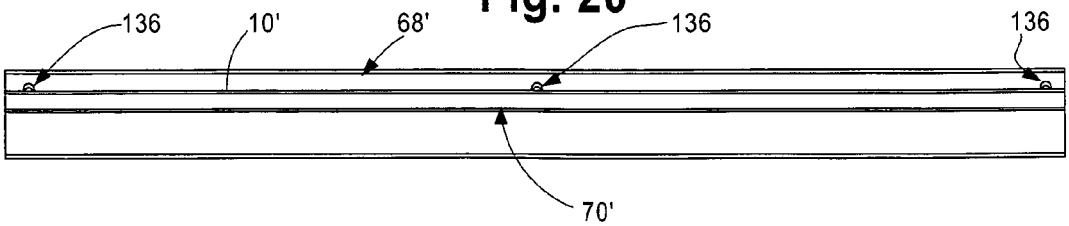
FIG. 20 is a reduced, front, elevation view of the gutter hanger in FIGS. 15-19.

As seen most clearly in FIG. 10, the mounting portion 68 has the overall shape of the letter "M". This configuration can be conveniently formed as by bending a metal strip. The hanger 10 could alternatively be made partially or entirely from a non-metal material. A single strip may be used to define the mounting portion, the flat section 76, and the support portion 70. While a one-piece construction is preferable, it is not a requirement.

The inner and outer legs 96, 102 have vertical extents that are approximately equal and identified as H1. The first and second legs 90, 92 have vertical extents that are approximately equal and identified as H2. H2 is significantly greater than H1.

More specifically, the vertical extent H2 is selected so that the receptacle 88 has adequate depth to accept the full height of the depending portion 44 of the flashing 40. The dimension H2 can be selected so that the free edge 46 abuts to the bight portion 94 at the bottom of the receptacle 88 with the hanger 10 at the desired mounting height. By controlling the vertical dimension of the depending flashing portion 44, the hangers 10 can be simply and consistently guidingly slid upwardly relative to the flashing portion 44 to a desired mounting height.

A fastener 110, typically either a spike or a self-threading component, is directed consecutively through the outer leg 102, the second leg 92, the depending flashing portion 44, the first leg 90, the gutter rear mounting wall 52, and the inner leg 96, and into the fascia 34 to effect anchoring of the mounting portion 68 thereagainst. Pre-formed openings 112, 114, 116, 118 are provided consecutively through the outer leg 102, second leg 92, first leg 90, and inner leg 96. At least the opening 112 is elongate vertically to facilitate introduction of the fastener 110 and alignment with the openings 114, 116, 118 as the mounting portion 68 is changed from a relaxed state, shown in FIGS. 11-14, to the assembled and secured state, shown in FIG. 10. In the assembled and secured state, the first leg 90 is pressed against the depending flashing portion 44, which is pressed against the inner leg 96, which is in turn pressed against the fascia 34.

As seen in FIG. 10, the inner and first legs 96, 90 reside between the depending portion 44 of the flashing 40 and the fascia 34. The stacked legs 96, 90 perform a spacing function to fill a gap at 120 (FIG. 6) that normally is present between the depending flashing portion 44 of the flashing 40 and the fascia 34. Thus, the depending portion 44 conveniently aligns with the receptacle 88 as the mounting portion 68 is directed upwardly into the operative position of FIG. 10.

More specifically, the mounting portion 68 is aligned beneath the free edge 46 and thereafter slid upwardly so that the inner leg 96 slides guidingly against the fascia 34. The rounded shape of the bight portions 98, 104 also facilitates guided movement of the free edge 46 into the receptacle 88.

It is also preferred that the rear mounting wall 52 on the gutter 12 reside in the receptacle 100 between the inner leg 96 and first leg 90. The mounting portion 68 and gutter mounting wall 52 can be relatively configured and dimensioned so that the edge 121 of the mounting wall 52 abuts to the bight portion 98 with the hanger 10 to limit downward movement of the mounting portion 68 of the hanger 10 relative to the mounting wall 52 with the hanger 10 at a preferred/desired optimal operative height that properly presents the support portion 70 at the receptacle 86 so that the gutter 12 will be maintained at an optimal height and orientation.

While not preferred, the invention contemplates that the rear gutter wall 34 might be flush to the fascia 34 over its entire height, with the inner leg 96 and first leg 90 thereby residing between the rear gutter wall 52 and depending flashing portion 44.

With the multiple leg construction, a rigid support for the flat section 76 and support portion 70 is established. The flashing 40 becomes positively interlocked with the mounting portion 68. The rear mounting wall 52 on the gutter also becomes positively captively maintained against the fascia 34.

The gutter hanger 10 is shown to have at least one, and in this case two, openings 122 to accept fasteners 124 on a "T" bar hanger that can be used for a different type of installation.

In FIGS. 15-20, a further modified form of gutter hanger, according to the present invention, is shown at 10'. The gutter hanger 10' has essentially the identical side elevation configuration as the hanger 10, as can be seen by comparing FIGS. 12 and 19. That is, the gutter hanger 10' has a mounting portion 68' and a support portion 70'. The mounting portion 68' has the aforementioned "M" shape, defined by the corresponding first and second legs 90', 92' and inner and outer legs 96', 102'. A flat section 76' connects between the mounting and support portions 68', 70'.

The only significant difference between the hangers 10, 10' is that whereas the hanger 10 has a narrow width designed to cooperate with the gutter 12 at spaced, discrete locations, the corresponding components extend preferably over the full length of the gutter 12 on the hanger 10'.

The flat section 76' on the hanger 10' defines a porous wall that is configured to: a) allow passage of moisture through a top opening 130 on the gutter 12 into the trough 74; and b) block movement of foreign matter, such as leaves and other common debris, through the top opening 130, whereby such might accumulate within the trough 74 and block movement of water therealong. The porous wall defined by the flat section 76' may cover substantially the entire area of the top opening 130 to block debris passage into the trough 74. The porous wall may cover a lesser portion of the area, but preferably covers a substantial portion of the area, and at least a majority of that area, to avoid significant accumulation of debris in the trough 74 that must be manually removed.

The section 76' consists of a wall layer 132 with a plurality of openings 134 therethrough that allow water to pass, while blocking passage of material having a size greater than the effective diameter of the openings 134. The precise shape of the openings 134 is not critical to the present invention. Any construction that acts as a barrier to introduction of foreign matter into the trough 74, while allowing moisture to pass thereinto, is contemplated by the invention. As just one example, the wall layer 132 may have a series of elongate slits. No limitation is contemplated regarding the configuration, so long as the wall layer 132 is appropriately "porous".

With this design, fasteners can be directed into an aligned arrangement of through openings 136 at regularly spaced intervals, as selected based upon the nature of the gutter and its supporting structure.

Aside from defining a trough cover, the hanger 10' also potentially provides a more rigid support for the gutter 12 compared to the aforementioned hangers that locally support the gutter 12 at spaced locations.

The foregoing disclosure of specific embodiments is intended to be illustrative of the broad concepts comprehended by the invention.

The invention claimed is:

1. In combination:

a building frame defining a roof surface and a fascia, the roof surface and fascia meeting at an edge;

a water impervious covering over the roof surface;

flashing that wraps around the edge and extends between the roof surface and covering, the flashing having a depending portion that overlies the fascia and terminates at a free edge, a gutter hanger comprising: a) a mounting portion that is secured to the building frame; and b) a support portion;

a gutter that is secured to the building frame and engaged by the support portion to be maintained in an operative position upon the building frame, the mounting portion of the gutter hanger defining an upwardly opening "U" shape in which the depending portion of the flashing nests, wherein the upwardly opening "U" shape is defined by first and second legs and the mounting portion comprises an inner leg that is joined to the first leg through a first bight portion, the first and inner legs each residing between the depending portion of the flashing and the fascia, wherein the mounting portion comprises an outer leg that is joined to the second leg through a second bight portion, the depending portion of the flashing residing between the fascia and each of the second and outer legs; and a fastener that extends through each of the inner and outer legs and into the fascia.

2. The combination according to claim 1 wherein the gutter has a rear mounting wall and the first and inner legs and first bight portion cooperatively define an inverted "U" shape, the rear mounting wall defines an edge that abuts to the gutter hanger to thereby limit downward movement of the mounting portion of the gutter hanger relative to the rear mounting wall of the gutter with the mounting portion of the hanger at a desired operative height relative to the rear mounting wall of the gutter, wherein the edge on the rear mounting wall is defined at the first bight portion.

3. The combination according to claim 1 wherein the second and outer legs and second bight portion cooperatively define an inverted "U" shape.

4. The combination according to claim 3 wherein the first, second, inner and outer legs and first and second bight portions cooperatively define an "M" shape.

5. The combination according to claim 3 wherein the gutter has a rear mounting wall, a bottom wall, and a front wall and the rear mounting wall of the gutter resides between the first leg and the fascia.

6. The combination according to claim 1 wherein the gutter has a rear mounting wall, a bottom wall, and a front wall and the rear mounting wall of the gutter resides between the first and inner legs.

7. The combination according to claim 5 wherein the support portion of the gutter hanger engages the front wall of the gutter.

8. The combination according to claim 6 wherein the rear mounting wall, bottom wall, and front wall of the gutter cooperatively bound an upwardly opening trough, and the gutter hanger spans between the front and rear mounting walls on the gutter above the bottom wall.

9. The combination according to claim 8 wherein the trough has a top opening with an area and the gutter hanger comprises a porous wall that extends over a majority of the top opening area, the porous wall configured to: a) allow passage of moisture; and b) block movement of foreign matter such as leaves through the top opening and into the trough.

10. The combination according to claim 1 wherein the first, second, inner and outer legs each has a vertical extent and the vertical extent of each of the first and second legs is greater than the vertical extent of each of the inner and outer legs.

11. The combination according to claim 1 wherein the gutter hanger is formed as one piece.

12. In combination:

a) a gutter hanger comprising:

a mounting portion to be secured to a building frame and a support portion to engage a gutter in an operative position on a building frame, the mounting portion comprising first and second legs joined together to define an upwardly opening "U" shape to receive a depending flashing portion with the mounting portion secured to a building frame, wherein the mounting portion further comprises an inner leg that is joined to the first leg through a first bight portion, the first and inner legs and first bight portion cooperatively defining an inverted "U" shape, the inner leg and first leg in substantially parallel and closely adjacent relationship with each other; and b) a building frame comprising a roof surface and a fascia that meet at an edge, flashing that wraps around the edge, and a gutter that is maintained in an operative position upon the building frame by the gutter hanger, the flashing having a depending portion that resides between the first and second legs, wherein with the gutter maintained in the operative position, the first leg is pressed against a depending portion of the flashing, a mounting wall of the gutter is pressed and the first leg, and the inner leg is pressed against the fascia.

13. A gutter hanger comprising:

a mounting portion to be secured to a building frame and a support portion to engage a gutter in an operative position on a building frame, the mounting portion comprising first and second legs joined together to define an upwardly opening "U" shape to receive a depending flashing portion with the mounting portion secured to a building frame, wherein the mounting portion further comprises an inner leg that is joined to the first leg through a first bight portion, the first and inner legs and first bight portion cooperatively defining an inverted "U" shape, the inner leg and first leg in substantially parallel and closely adjacent relationship with each other, wherein the mounting portion comprises an outer leg that is joined to the second leg through a second bight portion, the second and outer legs and second bight portion cooperatively defining an inverted "U" shape, the gutter hanger having a height and the first and second bight portions are at substantially the same height, wherein a fastener passes through the first leg, second leg, and the inner and outer legs.

14. The gutter hanger according to claim 13 wherein the first, second, inner and outer legs and first and second bight portions cooperatively define an "M" shape.

15. The combination according to claim 12 wherein the gutter hanger comprises a porous wall to extend over a substantial area of a top opening of a trough defined by a gutter that is operatively mounted to a building frame through the gutter hanger, the porous wall configured to: a) allow passage of moisture; and b) block movement of foreign matter such as leaves through the top opening and into the trough.

16. The gutter hanger according to claim 14 wherein the gutter defines an upwardly opening trough and a mounting wall and a front wall, the gutter hanger spanning the trough and engaging the front wall.

17. A gutter hanger comprising:

a mounting portion to be secured to a building frame and a support portion to engage a gutter in an operative position on a building frame, the mounting portion comprising first and second legs joined together to define an upwardly opening "U" shape to receive a depending flashing portion with the mounting portion secured to a building frame, wherein the mounting portion further comprises an inner leg that is joined to the first leg through a first bight portion, the first and inner legs and first bight portion cooperatively defining an inverted "U" shape, wherein the mounting portion comprises an outer leg that is joined to the second leg through a second bight portion, the second and outer legs and second bight portion cooperatively defining an inverted "U" shape, the gutter hanger having a height and the first and second bight portions are at substantially the same height, wherein the first, second, inner and outer legs and first and second bight portions cooperatively define an "M" shape, wherein the first, second, inner and outer legs have aligned openings to allow a fastener to be directed therethrough.

18. The combination according to claim 15 wherein the trough has a top opening with an area and the gutter hanger comprises a porous wall that extends over a majority of the top opening area, the porous wall configured to: a) allow passage of moisture; and b) block movement of foreign matter such as leaves through the top opening and into the trough.

19. The combination according to claim 12 wherein the gutter hanger has a support portion that engages the front wall of the gutter and an elongate section between the mounting and support portions, wherein the elongate section comprises a flat strip with a reinforcing rib.

20. A gutter hanger comprising:

a mounting portion to be secured to a building frame and a support portion to engage a gutter in an operative position on a building frame, the mounting portion comprising first and second legs joined together to define an upwardly opening "U" shape to receive a depending flashing portion with the mounting portion secured to a building frame, wherein the mounting portion further comprises an inner leg that is joined to the first leg through a first bight portion, the first and inner legs and first bight portion cooperatively defining an inverted "U" shape, the gutter hanger provided in combination with a building frame defining a roof surface and a fascia that meet at an edge, flashing that wraps around the edge, and a gutter that is maintained in an operative position upon the building frame by the gutter hanger, the flashing having a depending portion that resides between the first and second legs, the gutter hanger provided further in combination with a fastener that extends through the inner leg and first leg and into the fascia.

21. The combination according to claim 12 wherein the depending portion of the flashing has a bottom free edge that abuts to the mounting portion of the gutter hanger as the gutter hanger is moved upwardly relative to the flashing portion to a desired operative position to block further upward movement of the mounting portion of the gutter hanger with the gutter hanger in the desired operative position.

* * * * *

UNITED STATES PATENT AND TRADEMARK OFFICE

CERTIFICATE OF CORRECTION

PATENT NO. : 8,347,557 B2
APPLICATION NO. : 12/590300
DATED : January 8, 2013
INVENTOR(S) : Kenneth W. Minor et al.

It is certified that error appears in the above-identified patent and that said Letters Patent is hereby corrected as shown below:

Claim 12, final paragraph (column 9, lines 12-15), should read as follows:

wherein with the gutter maintained in the operative position, the first leg is pressed against a depending portion of the flashing, a mounting wall of the gutter is pressed against the inner leg and the first leg, and the inner leg is pressed against the fascia.

Signed and Sealed this
Twenty-sixth Day of March, 2013

Teresa Stanek Rea
*Acting Director of the United States Patent and Trademark Office*